United States Patent [19]

Mravic et al.

[11] 4,067,750

[45] Jan. 10, 1978

[54] METHOD OF PROCESSING COPPER BASE ALLOYS

[75] Inventors: Brian Mravic, North Haven; Stanley Shapiro, New Haven; W. Gary Watson, Cheshire; Eugene Shapiro, Hamden, all of Conn.

[73] Assignee: Olin Corporation, New Haven, Conn.

[21] Appl. No.: 652,997

[22] Filed: Jan. 28, 1976

[51] Int. Cl.[2] ..... C22F 1/08; C22C 9/00

[52] U.S. Cl. ..... 148/2; 75/153; 148/12.7 C; 148/32.5

[58] Field of Search ..... 75/153; 148/2, 11.5 C, 148/12.7 C, 160, 32, 32.5

[56] References Cited

U.S. PATENT DOCUMENTS

| | | | |
|---|---|---|---|
| 3,143,442 | 8/1964 | Watts | 75/153 X |
| 3,194,655 | 7/1965 | Pels et al. | 75/153 X |
| 3,330,653 | 7/1967 | Paces et al. | 75/153 |
| 3,357,824 | 12/1967 | Saarivirta | 75/153 |
| 3,392,016 | 7/1968 | Opie et al. | 75/153 |
| 3,574,001 | 4/1971 | Ence | 75/153 |

FOREIGN PATENT DOCUMENTS

| | | | |
|---|---|---|---|
| 38-18064 | 9/1963 | Japan | 75/153 |
| 185,068 | 7/1966 | U.S.S.R. | 75/153 |
| 206,095 | 1/1968 | U.S.S.R. | 75/153 |

*Primary Examiner*—C. Lovell

*Attorney, Agent, or Firm*—Robert A. Dawson; Robert H. Bachman

[57] ABSTRACT

A process of heat treating and mechanically working copper base alloys containing chromium, zirconium and vanadium is disclosed. The combination of alloying ingredients, hot and cold rolling, annealing and aging steps increases both the strength and electrical conductivity properties of the alloy without excessive cold working or aging.

7 Claims, No Drawings

METHOD OF PROCESSING COPPER BASE ALLOYS

BACKGROUND OF THE INVENTION

Perhaps the most desirable attribute which copper alloys may possess is a combination of high strength and high electrical conductivity. Increases in electrical conductivity in an alloy are often brought about by precipitation of alloying element or elements from solid solution. This precipitation usually helps to increase the strength of the alloy but only up to a point. The precipitation heat treatment of the alloy which imparts maximum strength to the alloy is usually not the same as the precipitation treatment which imparts maximum electrical conductivity. For a given aging temperature, maximum electrical conductivity occurs at longer aging times than does maximum strength.

Zirconium and chromium are well-known additions to copper alloys for providing desirable high strength combined with high electrical conductivity. Commercial copper-chromium and copper-zirconium alloys are available, and copper-chromium-zirconium alloys are also known. Precipitation of chromium in copper is known to give large increases in strength and electrical conductivity over the values for the solid solution. The resultant precipitation hardened alloys have lower electrical conductivity but significantly higher strength than pure copper. Precipitation of zirconium in copper is known to give large increases in electrical conductivity but only small increases in strength over the values for the solid solution. Zirconium also significantly raises the recrystallization temperature of copper. The resultant alloys have lower conductivity than copper but a much better resistance to softening at high temperatures.

Russian Pat. No. 185,068 discloses copper base alloys that contain chromium, zirconium and vanadium. The patent does not teach any processing steps for this alloy combination.

It is a principal object of the present invention to provide a process which is capable of improving both the strength and electrical conductivity of copper base alloys.

It is a further object of the present invention to provide a process as aforesaid which is relatively simple and convenient to use on a commercial scale.

Further objects and advantages of the present invention will appear hereinafter.

SUMMARY OF THE INVENTION

In accordance with the present invention it has been found that the foregoing objects and advantages may be readily achieved.

In the following specification all ingredient percentages will be in terms of weight percent. The process of the present invention comprises:

A. casting a copper base alloy containing 0.05–1.25 percent chromium, 0.01–1.0 percent zirconium and 0.01–1.0 percent vanadium, balance essentially copper;

B. hot rolling the alloy at a starting temperature of 850°–1000° C to effect the maximum solid solution of all alloying ingredients;

C. optionally solution annealing the rolled alloy at a solutionizing temperature of 900°–1000° C, preferably 925°–1000° C, for 5 minutes to 2 hours and preferably 15 minutes to 1 hour;

D. rapidly cooling the alloy to maintain said maximum solid solution of all alloying ingredients;

E. cold rolling the said alloy to a total reduction of at least 25 percent and preferably at least 45 percent;

F. interannealing said cold rolled alloy for 15 seconds to 5 minutes in an annealing furnace at 800°–1000° C, said alloy being cold rolled to a total reduction of at least 25 percent and preferably at least 45 percent after being interannealed;

G. aging said alloy at 350°–600° C and preferably 375°–500° C for one-half to 48 hours, said aging being accomplished in cycles with said cold rolling, if desired, where the cycles end with either an aging or cold rolling step.

The process of the present invention may be readily utilized to provide copper base alloys having high strength and high electrical conductivity. It is known in the art to provide additions of chromium and/or zirconium to copper in order to provide increased properties to the resulting alloy. Each alloying element, however, usually produces its maximum effect upon the alloy at different combinations of aging time and temperature. The present process provides surprising benefits in both strength and electrical conductivity in spite of the different effects of chromium and zirconium upon copper as known in the art. It can be seen that the process described hereinbelow is relatively easy to perform and is readily adaptable to commercial operations.

Further advantages of the instant process will appear hereinbelow.

DETAILED DESCRIPTION OF THE INVENTION

The present invention provides its beneficial increase in strength and electrical conductivity through the following steps. These steps include casting a copper base alloy, hot rolling this alloy in such a manner so as to effect the maximum solid solution of all alloying ingredients, optionally solution annealing the rolled alloy, rapidly cooling the alloy so as to maintain said solid solution, cold rolling the alloy and aging the alloy.

The hot rolling step of the present invention may by itself be used to provide the effect of a solution annealing step. This is generally accomplished by heating the alloy to a temperature between 900°–1000° C and hot rolling the alloy at this temperature for such a period of time so as to produce the maximum solid solution of all alloying ingredients. It is preferred that the temperature be at least 900° C.

The alloys used in the present process are generally cast at a temperature which ranges between 25° C above the melting point of the alloy to 1300° C. This casting may be done by any known and convenient method.

The hot rolling reduction requirement is generally what is most convenient for further working. The present process has no particular dimensional requirements other than that the hot rolling be accomplished according to good mill practice. If the hot rolling step is also utilized to provide solution annealing of the alloy, the main consideration is that maximum solid solution of the alloying constituents be present in the alloy. This permits the later precipitation during aging of the most desirable high volume fraction of fine uniform dispersions of intermediate solid phases consisting of chromium, zirconium and vanadium, the phases existing in the alloy matrix either as independent or intermixed phases.

The solution annealing step of the instant invention, whether performed as part of the hot rolling or as a separate step after hot rolling, also provides for maximum solid solution of the alloying ingredients. This solutionizing is accomplished at a temperature between 900°-1000° C for 5 minutes to 2 hours. It is preferred that the solution annealing be accomplished at a temperature between 925°-1000° C for approximately 15 minutes to 1 hour. It should be noted that the solution annealing step can take place at any point in the instant process after the initial hot rolling step, provided that quenching, cold rolling and aging steps are performed after the solution anneal.

The alloy, after being either hot rolled alone or hot rolled in combination with the solution annealing, is then rapidly cooled so as to maintain said maximum solution of the alloying ingredients. This cooling may be accomplished according to procedures well known in this art, whether using air or a liquid as the cooling medium.

The next step in the present process provides for cold rolling of the treated alloy. This cold rolling step is utilized to provide an increase in strength to the alloy as well as being used to meet gage requirements. The alloy is generally cold rolled to a total reduction of at least 25 percent and preferably at least 45 percent. This cold rolling step may be the final cold rolling before aging of the alloy material if the material is down to the final desired gage. The cold rolling may be utilized in cycles with an aging step, so that the cycle may end with either an aging or a cold rolling step.

The alloy may be interannealed after cold rolling to provide a fine grain recrystallized product. This annealing is usually accomplished by a strip anneal procedure wherein the alloy is subjected to an annealing treatment in a furnace which is kept at 800°-1000° C. The residence time of the alloy in the strip annealing furnace is approximately 15 seconds to 5 minutes. In this period of time, the metal temperature reaches between 600°-950° C. The alloy, after being subjected to the interannealing step, must undergo additional cold rolling.

The cold rolling of the alloy is followed by an aging step. This aging is generally performed at a temperature between 350°-600° C for one-half to 48 hours, preferably at a temperature between 375°-500° C. This aging is performed to increase the mechanical and electrical conductivity properties of the alloy. After aging, the minimum electrical conductivity of the alloy increases to 70% IACS and generally 75% IACS. At least one aging step is required in the instant process.

As stated above, the treatment of the alloy may stop with the aging step or the alloy may be further cold rolled to meet the desired gage requirements. The procedures of aging and cold rolling may be accomplished in cycles, with as many cycles being used as desired in order to meet desired properties.

The addition of optional additives for specific purposes is also contemplated by the present invention. Additives which may be added in small but effective amounts to the alloy include deoxidizers such as aluminum, magnesium, phosphorus, boron and mischmetal. Additives such as lead, sulfur, selenium or tellurium may be used in the alloy in small but effective amounts to improve machinability of the alloy. Small but effective amounts of arsenic or antimony may be added to the alloy to improve its resistance to corrosion or stress corrosion. The amounts of these optional additives should not exceed the minimum amounts required to achieve the desired objectives, since to do so would unnecessarily reduce the electrical conductivity of the resulting alloy.

The process of the present invention and advantages obtained thereby may be readily understood from a consideration of the following illustrative examples.

EXAMPLE I

Copper base alloys were provided having the following compositions: Alloy A - chromium 0.5 percent, zirconium 0.013 percent, vanadium 0.23 percent, balance essentially copper; Alloy B - chromium 0.5 percent, zirconium 0.16 percent, vanadium 0.36 percent, balance essentially copper. These alloys were melted in a vacuum at a temperature greater than 1300° C, backfilled with argon and cast between 1250°-1300° C. The cast alloys were then hot rolled at 850° C, after which they were subjected to a solution anneal treatment at 1000° C. The rolled and solution treated products were then surfaced milled, cold rolled to a reduction of 75 percent, aged for 3 hours at 440° C and then cold rolled to an additional 75 percent reduction. Hardness and electrical conductivity values for each step of the process are indicated in Table I. Ultimate tensile strength and yield strength values are shown for the alloys after the final processing step. It can be seen from Table I that the steps of the instant invention provide increasing values of strength and electrical conductivity for each step of the process.

TABLE I

STRENGTH AND CONDUCTIVITY OF Cu-Cr-Zr-V ALLOYS

| | | Alloy Identification | |
|---|---|---|---|
| | | A | B |
| A. Solution Treat | HV | 49.0 | 51.0 |
| | % IACS | 50.5 | 37.5 |
| B. A + CR 75% | HV | 125.0 | 136.0 |
| | % IACS | 47.5 | 36.5 |
| C. B + Age 440° C/3 hours | HV | 150.0 | 172.0 |
| | % IACS | 86.5 | 79.0 |
| D. C + CR 75% | HV | 174.0 | 194.0 |
| | % IACS | * | * |
| | UTS | 82.0 | 95.0 |
| | YS | 77.0 | 92.0 |

HV = vickers hardness
% IACS = conductivity
UTS = ultimate tensile strength, ksi
YS = yield strength, ksi
* = data not taken

EXAMPLE II

Alloys A and B were processed according to Example I with a variety of aging treatments employed before the final cold reduction. Hardness and electrical conductivity values for each of these different aging treatments are shown in Table II. It can be seen from Table II that Alloy B, when aged at 450° C for 2 hours or at 500° C for one-half hour provides a hardness value of approximately 210HV, and thus an estimated tensile strength above 90 ksi.

TABLE II

STRENGTH AND CONDUCTIVITY FOR VARYING AGING TREATMENTS

| | Alloy Identification | |
|---|---|---|
| | A | B |
| Aging Treatment Temp. ° C/Time Hours | Vicker Hardness/%IACS Conductivity After Aging | |
| 450° C/1 hour | 167/85 | 218/76.5 |
| 450° C/2 hours | 170/89 | 208/80 |
| 440° C/3 hours | 174/86.5 | 194/79 |

TABLE II-continued

STRENGTH AND CONDUCTIVITY FOR VARYING AGING TREATMENTS

| Aging Treatment Temp. ° C/Time Hours | Alloy Identification A | B |
|---|---|---|
| | Vicker Hardness/%IACS Conductivity After Aging | |
| 500° C/1/2 hour | 167/89.5 | 212/81.5 |

*Process: Solution treat + CR 75% + Age + CR 75%

It may be seen from Table III that both the strength and electrical conductivity properties of the alloys of Example I, when processed according to the instant invention, exceed those properties of binary copper-chromium and copper-zirconium alloys. The binary alloys of Table III have been processed according to procedures known in the art which have been used to increase strength and electrical conductivity properties.

TABLE III

COMPARATIVE PROPERTIES WITH BINARY CuCr, CuZr ALLOYS

| Alloy: | Cu-0.7 Cr* | Cu-0.15 Zr* | A** | B** |
|---|---|---|---|---|
| UTS, ksi | 74 | 65.5 | 82 | 95 |
| 0.2% YS, ksi | 65.5 | 60 | 77 | 92 |
| % IACS | 85 | 93 | 86.5 | 79 (as aged) |

*Process: ST + CR 90% + Age 450° C/1 hour
S. G. Temple, Metallurgical Reviews, Vol. 11, p. 47-60, 1966.
**Process: ST + CR 75% + Age 440° C/3 hours + CR 75%

The alloys of Example I, when processed according to the present invention, exhibit strength and electrical conductivity properties which exceed even relatively complex copper alloys containing chromium and zirconium as shown in Table IV. Of these complex alloys, only Alloy E of Table IV comes close to matching the overall properties obtained with the alloys of Example I when processed according to the steps of the instant invention. It should be noted, however, that Alloy E was produced in the wire form and thus requires a final aging and a much higher percentage cold reduction to meet the combined strength and electrical conductivity properties possessed by Alloy B of Example I.

Therefore, it may be seen from the foregoing examples that the highly desirable combination of high strength and high electrical conductivity in copper base alloys may be readily obtained by the process of the instant invention without resorting to very high percentage cold reduction values as may be seen from Table IV.

TABLE IV

COMPARISON WITH COMPLEX Cr, Zr CONTAINING ALLOYS

| Alloy: | A** | B** | C Cu-0.28Cr-0.14Zr-0.055 Mg[c] | D Cu-0.52Cr-0.42 Zr[d] | E Cu-0.4Cr-0.15Zr-0.05 Mg[e] |
|---|---|---|---|---|---|
| UTS, ksi | 82 | 95 | 89 | 76.5 | 100 (95) |
| 0.2% YS, ksi | 77 | 92 | — | — | 97 (90) |

TABLE IV-continued

COMPARISON WITH COMPLEX Cr, Zr CONTAINING ALLOYS

| Alloy: | A** | B** | C Cu-0.28Cr-0.14Zr-0.055 Mg[c] | D Cu-0.52Cr-0.42 Zr[d] | E Cu-0.4Cr-0.15Zr-0.05 Mg[e] |
|---|---|---|---|---|---|
| % IACS | 86.5 | 79 (as aged) | 80 | 78 | 65 (80) |

**Process: ST + CR 75% + Age 440° C/3hours + CR 75%
[c]Process: ST + CW 90% + 475° C/ 1/2 hour Opie et al., J. of the Inst. of Metals, Vol. 98, July, 1970, p. 204.
[d]Process: ST + CR 60% + 475° C S. Temple, Metallurgical Reviews, Vol. 11, p. 47, 1966.
[e]Process: ST + 60% RA + 450° C, 1/2 hour + 90% RA + (475° C, 1/2 hour) (475° C, 1/2 hour) refers to final age.
P. W. Taubenblatt et al., Metals Engineering Quarterly, November, 1972, p. 41.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for improving both the strength and electrical conductivity properties of copper base alloys, which comprises:

A. casting a copper base alloy consisting essentially of 0.05–1.25 weight percent chromium, 0.01–1.0 weight percent zirconium and 0.01–1.0 weight percent vanadium, balance essentially copper;

B. hot rolling the alloy at a starting temperature of 850°–1000° C to effect the maximum solid solution of all alloying ingredients;

C. rapidly cooling the alloy to maintain said maximum solid solution;

D. cold rolling the alloy to a total reduction of at least 25 percent;

E. grain refining the alloy by annealing the cold rolled alloy at 800°–1000° C for 15 seconds to 5 minutes;

F. further cold rolling the alloy to a total reduction of at least 25 percent; and G. aging the alloy at 350°–600° C for one-half to 48 hours.

2. A process as in claim 1 wherein said alloy is subjected to a solutionizing temperature of 900°–1000° C for 5 minutes to 2 hours; said solutionizing occurring at any point in said process after the initial hot rolling step, provided that cooling, cold rolling and aging steps are performed on the alloy after it is subjected to said solutionizing temperature.

3. A process as in claim 1 wherein said aging step is accomplished in cycles with said cold rolling, where the cycles end with either an aging or a cold rolling step.

4. A process as in claim 1 wherein the alloy is cast at a temperature which ranges between 25° C above the melting point of the alloy to 1300° C.

5. A process as in claim 1 wherein the hot rolling occurs at a temperature of 900°–1000° C.

6. A process as in claim 1 wherein the cold rolling step is performed to a total reduction in the alloy of at least 45 percent.

7. A wrought copper base alloy in the rolled and aged condition produced by the process of claim 1.

* * * * *